US006405966B1

(12) United States Patent
Lieber et al.

(10) Patent No.: US 6,405,966 B1
(45) Date of Patent: Jun. 18, 2002

(54) PROCESS AND CROSS-WINDING DEVICE FOR LAYING A THREAD

(75) Inventors: Reinhard Lieber, Sprockhövel; Friedhelm Lenz, Wuppertal, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/463,523

(22) PCT Filed: Jul. 22, 1998

(86) PCT No.: PCT/EP98/04581

§ 371 (c)(1),
(2), (4) Date: Jan. 25, 2000

(87) PCT Pub. No.: WO99/05055

PCT Pub. Date: Feb. 4, 1999

(30) Foreign Application Priority Data

Jul. 26, 1997 (DE) ..... 197 32 222

(51) Int. Cl.[7] ..... B65H 54/28

(52) U.S. Cl. ..... 242/478.2; 242/477.5; 242/481.4; 242/481.6

(58) Field of Search ..... 242/477.5, 477.6, 242/478.2, 481.6, 481.4

(56) References Cited

U.S. PATENT DOCUMENTS

| | | | | |
|---|---|---|---|---|
| 4,915,315 A | | 4/1990 | Kamp et al. | |
| 5,470,026 A | * | 11/1995 | Kotzur | 242/478.2 |
| 5,727,744 A | * | 3/1998 | Threlkeld et al. | 242/477.6 |
| 5,918,829 A | * | 7/1999 | Fäh | 242/478.2 X |
| 6,008,613 A | * | 12/1999 | Baader | 242/477.5 X |
| 6,065,712 A | * | 5/2000 | Mayer et al. | 242/477.5 X |
| 6,189,826 B1 | * | 2/2001 | Oberstrass | 242/473.8 |

FOREIGN PATENT DOCUMENTS

| | | |
|---|---|---|
| DE | 37 39 693 A1 | 6/1989 |
| DE | 43 10 905 A1 | 10/1994 |
| EP | 0 302 461 B1 | 2/1989 |
| EP | 0 302 461 A1 | 2/1989 |
| EP | 0 453 622 A1 | 10/1991 |
| EP | 0 453 622 B1 | 10/1991 |
| EP | 0 510 829 A1 | 10/1992 |
| EP | 0 829 443 A1 | 3/1998 |
| EP | 0 838 422 A1 | 4/1998 |
| WO | 92 08664 A | 5/1992 |

* cited by examiner

*Primary Examiner*—Michael R. Mansen
(74) *Attorney, Agent, or Firm*—Alston & Bird LLP

(57) ABSTRACT

A method and an apparatus for traversing a yarn, wherein a traversing yarn guide is moved by means of an electric motor. The actual position of the yarn guide is continuously determined by means of a measuring device and supplied to a control device, which performs a comparison between the actual and desired positions of the traversing yarn guide, and the control device generates a corresponding differential signal for controlling the operation of the electric motor.

25 Claims, 6 Drawing Sheets

PROCESS AND CROSS-WINDING DEVICE FOR LAYING A THREAD

BACKGROUND OF THE INVENTION

The present invention relates to a method of traversing an advancing yarn during the winding of the yarn into a yarn package.

A method of this kind and an apparatus for traversing a yarn are known from EP 0 453 622 B1. In this known process, a traversing yarn guide is mounted on a belt of a belt drive. The belt drive is driven via a stepping motor in such a manner that the traversing yarn guide reciprocates the yarn within a traverse stroke. In the region of reversal, the stepping motor is supplied with a saturation current and in the remaining region with a rated current. The motions are controlled at a position within the traverse stroke by means of a sensor.

However, the known method is subject to physical and technical limitations. From the physical viewpoint, the stepping motor represents a spring-mass system, which is liable to vibrate in the case of rapid changes in position and to perform uncontrolled movements. During a movement of the yarn guide, the reference or zero position is passed only twice. The accuracy of positioning outside of the zero position is undefined. At higher rotational speeds, such as, for example, a production speed of 1,000 m/min., this method is no longer able to operate with the necessary accuracy.

It is therefore the object of the invention to create a method and apparatus for traversing a yarn, which permit an exact positioning of the yarn within the traverse stroke. A further object of the invention is to ensure an optimal utilization of the electric motor in each traverse stroke.

SUMMARY OF THE INVENTION

The above and other objects and advantages of the invention are achieved by the provision of a yarn winding method and apparatus wherein the yarn traversing mechanism includes at least one yarn guide, and means including an electric motor for traversing the one yarn guide along the rotating winding spindle and so as to define a traverse stroke. A sensor is provided for continuously monitoring the actual position of the one yarn guide as it moves along the traverse stroke, and control means is provided for comparing the monitored actual position of the one yarn guide with a predetermined desired position, and generating a control signal in response to a difference between the monitored actual position of the one yarn guide and the predetermined desired position so as to control the operation of the electric motor. The yarn is thereby accurately positioned along the entire traverse stroke in accordance with a predetermined winding program.

The invention as summarized above is not suggested by EP 0 302 461. In the traversing apparatus of that document, a plurality of traversing yarn guides are mounted one after the other on a belt and are driven by means of a servomotor. This servomotor is commuted by means of a resolver, so as to be reversed according to a predetermined desired function. The position of the traversing yarn guide is not detected. The known traversing apparatus, which is used at production speeds from 150 to 170 m/min., is totally unsuited for reciprocating a yarn at traversing speeds up to 7 m/sec. due to its high mass moment of inertia.

However, the method of the present invention facilitates such a highly dynamic movement of the traversing yarn guide without difficulties. The special advantage of the invention lies in that a constant adjustment occurs between the actual position and the desired position of the traversing yarn guide. A measuring device coupled with the traversing apparatus offers the possibility of utilizing the full dynamics and the full moment of the electric motor, without incurring the risk that the motor falls out of step. Primarily, this generates a high accuracy and reproducibility in the outer ranges of the movement of the traversing yarn guide, namely in the region of the reversal at the outer edge of the yarn package, while the yarn is being traversed.

In the event of a deviation between the actual position and the desired position, a differential signal is generated for controlling the electric motor. In this instance, the setting of the electric motor is understood to be the relation between the movable rotor and the stationary stator of the electric motor. Thus, it is made possible to move the traversing yarn guide in a position-controlled manner over the entire traverse stroke. As a result of the continuous adjustment between the actual position of the traversing yarn guide and the desired position of the traversing yarn guide which is determined by the electric motor, the electric motor is in a position to exactly apply the energy or torque that is required for every position of the traversing yarn guide.

The special advantage of the invention lies in that the electric motor is controllable in an amplitude-controlled manner. This means, that in case of a deviation between the actual and the desired position, the electric motor will receive by means of the differential signal a current that is varied in its amplitude. In particular, this allows a high accuracy to be realized for the positioning of the traversing yarn guide in the reversal region.

In a further, advantageous variant of the method, the differential signal is also used to change the rotational speed of the electric motor. This allows to adjust the speed of the traversing yarn guide by the frequency-controlled motor in every position within the traverse stroke to a predetermined sequence, so that the laws of winding can be put into action with a high accuracy during the formation of packages. For example, random winds, precision winds, or conical packages can be realized with corresponding speed profiles and with a high accuracy. The traversing speed is in a range of about 800 double strokes per minute.

In this connection, it will be especially advantageous, when for each kind of wind a respective course of the desired position of the traversing yarn guide is predetermined within a traverse stroke for controlling the electric motor. The course of the desired position of the yarn guide predetermines the position and the speed of the traversing yarn guide. With that, the method is suitable for carrying out stroke reductions. The stroke reductions may be varied as desired on one side or on both sides according to a predetermined time program.

To be able to wind yarn reserves as precisely as possible at the beginning of a winding cycle, it will be advantageous, when at the beginning of the winding cycle, an adjustment is made between the position of the traversing yarn guide and the setting of the electric motor with the aid of a reference position.

Especially advantageous is the variant of the method, wherein the reference position is defined by one of the ends of a tube that receives the package. With that, it is ensured that despite differently long tubes, the available winding length of the tube corresponds in each instance exactly to the traverse stroke.

The method of the present invention offers the possibility of detecting the actual position of the traversing yarn guide by a sensor that is optically, acoustically, or electrically coupled with a measuring device. In the case of an optical detection, for example, lasers are used, which detect the position of the yarn guide by way of measuring the distance.

However, it is also possible to use ultrasound sensors for measuring the actual position of the yarn guide.

In a particularly advantageous variant of the method, wherein the yarn guide is moved by means of a belt drive, the sensor of the measuring device is connected to the motor shaft of the electric motor, which drives a drive pulley of the belt drive.

When using this variant, it is possible to detect the angle of rotation or the number of revolutions of the motor shaft, which corresponds, based on the transmission mechanism, to the respective actual position of the yarn guide.

Especially advantageous is the variant of the method, wherein the sensor is arranged on one of the belt pulleys, and determines an angle of rotation or the number of revolutions of the belt pulley.

Basically, the method of the present invention can be applied to any kind of drive of the traversing yarn guide. The variant of the method, wherein the traversing yarn guide is driven by means of a stepping motor is especially of advantage because of its high flexibility. Likewise, the low moments of inertia of the stepping motors make it possible to impart a high torque, which is necessary especially in the reversal regions of the traversing yarn guide.

The method of the present invention may be carried out both with a traversing apparatus, wherein the traversing yarn guide is reciprocated within a traverse stroke, and with a traversing apparatus, wherein two oppositely driven traversing yarn guides are moved within a traversing stroke. The traversing apparatus of the present invention distinguishes itself in particular by a reproducibility of the yarn deposit on the package as well as by its high flexibility with respect to the package build.

A particularly advantageous further development of the traversing apparatus provides that a plurality of traversing yarn guides are provided for reciprocating a plurality of yarns in winding positions arranged parallel to one another. In this arrangement, the traversing yarn guides moving in the same direction are driven by an electric motor. However, for controlling the position and speed of the traversing yarn guides, the measuring device is associated to only one of the traversing yarn guides moving in the same direction. This configuration allows to control any desired number of parallel arranged winding positions of a machine.

To attain a high accuracy in the detection of the actual position of the traversing yarn guide, it is preferred to use the traversing apparatus, wherein a sensor of the measuring device is in contact with the traversing yarn guide.

With a use of a noncontacting sensor in a particularly preferred variant of the embodiment, the existing flexibility of the traversing apparatus is likewise further increased.

Thus, for purposes of determining the actual position of the traversing yarn guide, it is possible to use conventional sensors, such as optical laser sensors, acoustical ultrasound sensors, noncontacting magnetic or capacitive sensors, as well as electric rotation pickups.

Since due to constructional conditions the scanning of the traversing yarn guide is often confronted with difficulties, a traversing apparatus is especially advantageous, wherein the measuring device for detecting the actual position of the traversing yarn guide is coupled with one of the drive means that moves the traversing yarn guide.

In this connection, the traversing apparatus wherein the traversing yarn guide is guided by means of a belt drive, represents a variant, wherein the masses being moved are small, so that the electric motor is able to impart the torque necessary for the high speeds.

In this variant, the belt is guided over a belt pulley and drive pulley. The electric motor is coupled with the drive pulley, so that the rotation is transmitted to the belt. The belt may also be formed by a cable or another tapelike means.

The further development of the traversing apparatus, wherein the sensor of the measuring device covers a number of markings provided per length unit on the belt, has the advantage that it thus senses the direct transmitting member of the movement of the traversing yarn guide. In this instance, it is possible to use as markings, for example, the projections of a cog belt.

The embodiment of the traversing apparatus, wherein the sensor of the measuring device is arranged directly on the electric motor in such a manner as to detect the angular position of the number of revolutions of the motor shaft connected to the drive pulley, leads to a particularly compact design.

In addition, it is possible to configure the connection of the measuring device to the control device in such a manner that high transmission accuracies of the signals are attained. The adjustment between the actual position and the desired position of the traversing yarn guide can thus be balanced within very short regulating times, while minimizing disturbance influences.

In this connection, the drive of the traversing yarn guide by means of a stepping motor is especially advantageous. As a result of the large number of paired poles, for example, fifty poles, it is possible to adjust the desired position of the traversing yarn guide very accurately within the traverse stroke. The measuring device and the therewith connected control system permit elimination of vibrations as occur frequently with the stepping motor in quick reversal actions. As a result, the stepping motor can be utilized far better than is possible in mostly only controlled operations.

BRIEF DESCRIPTION OF THE DRAWINGS

In the following, the invention is described in more detail with reference to some embodiments illustrated in the attached drawings, in which.

DETAILED DESCRIPTION OF THE PREFERRED EMBODIMENTS

Figure 1:
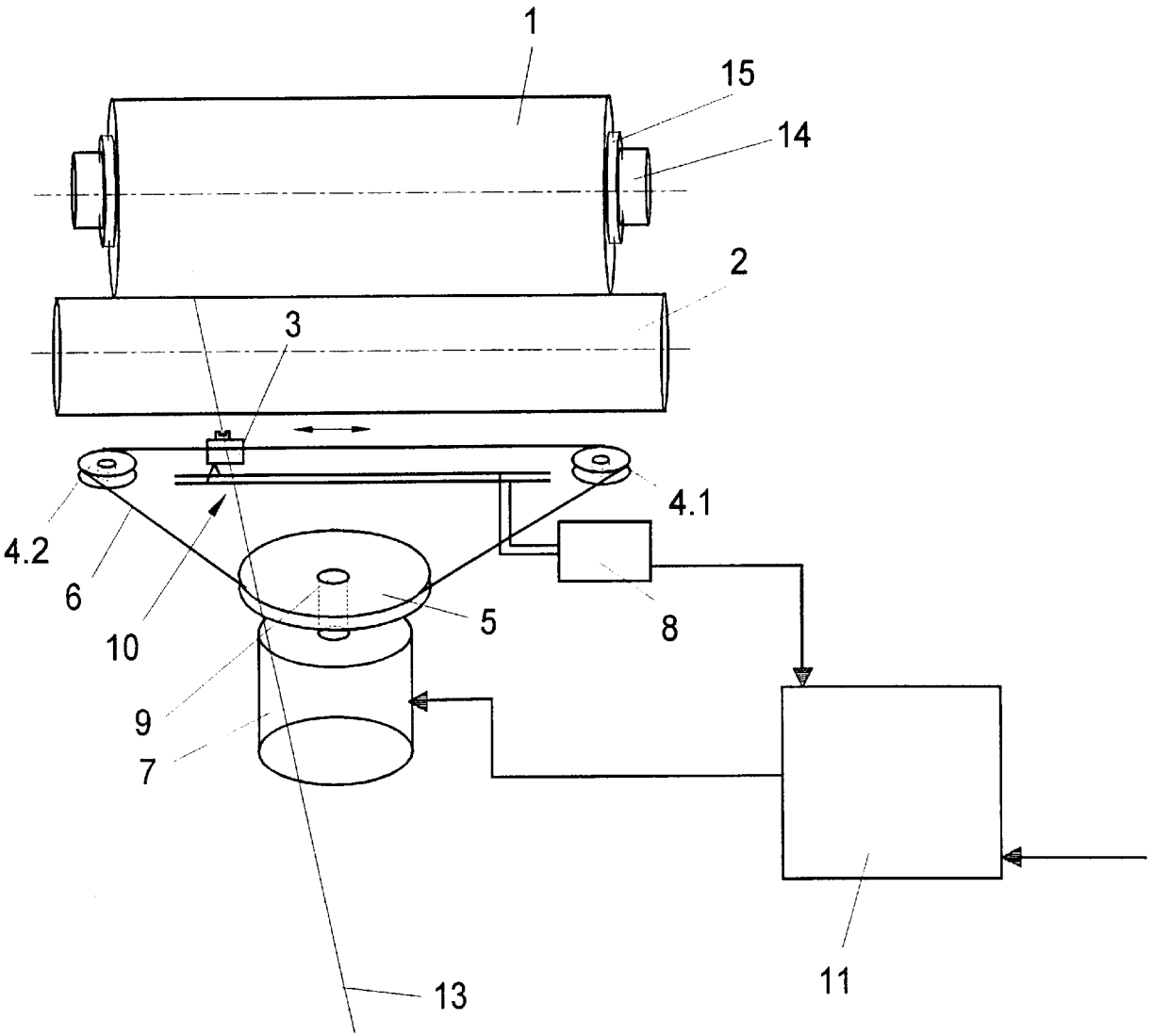
FIGS. 1–3 are each a schematic view of a first embodiment of a traversing apparatus in accordance with the invention, each having a different measuring device.
Figure 2:
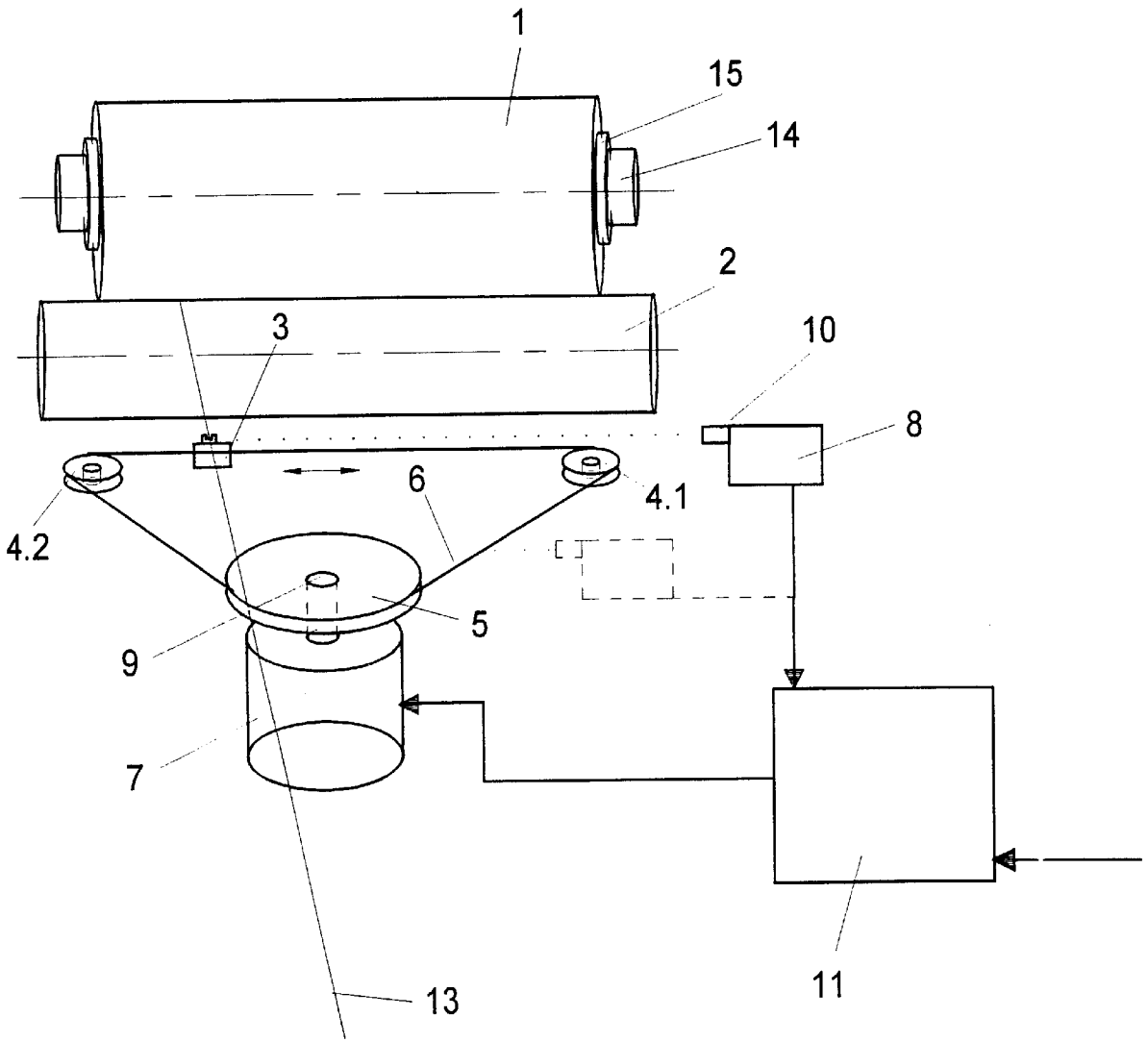
Figure 3:
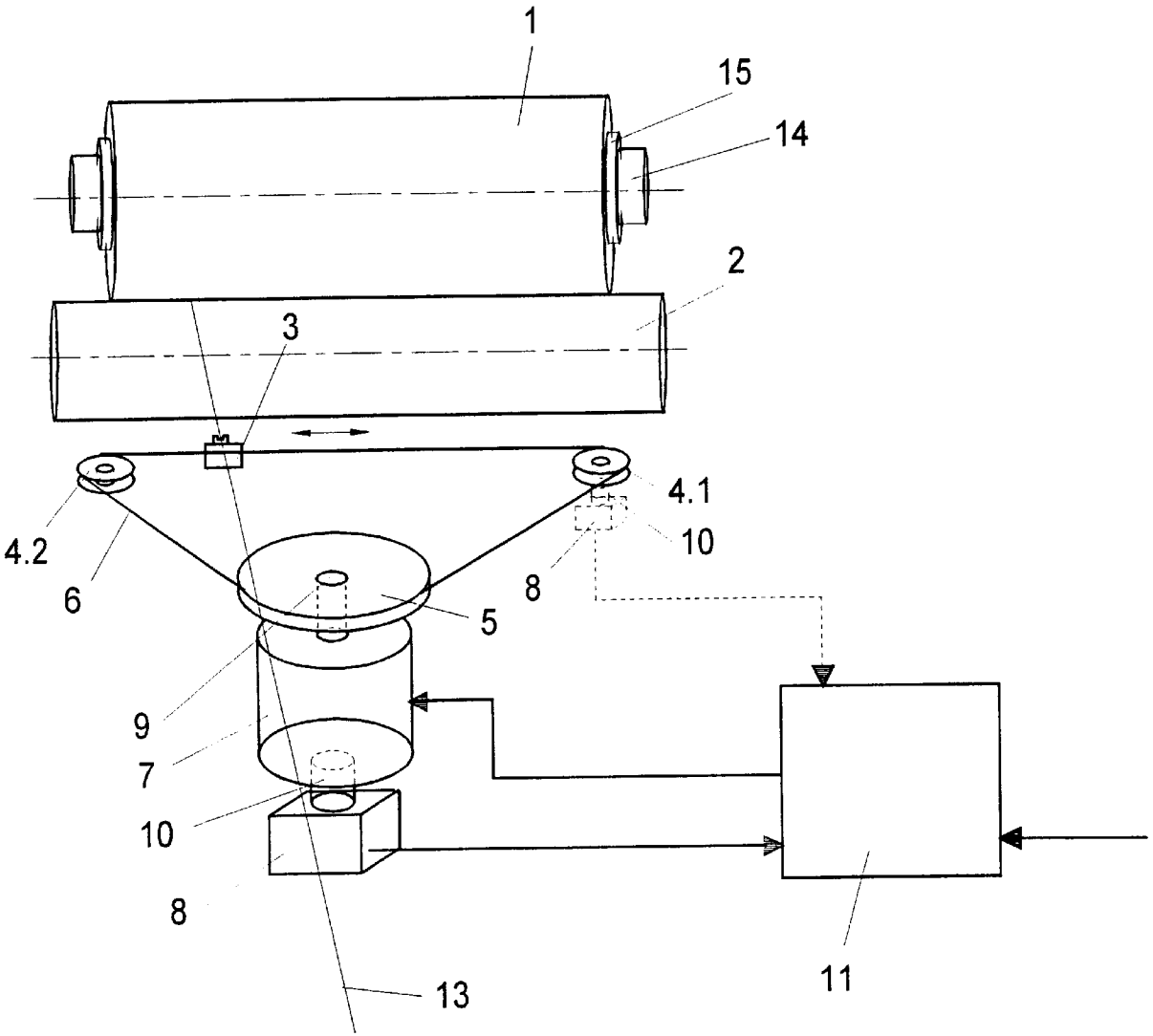

FIGS. 1 to 3 each show a traversing apparatus of the present invention. The traversing apparatus differ from one another by the design of the measuring device. For this reason, the following description is common to the traversing apparatus of FIGS. 1 to 3.

A traversing yarn guide 3 is reciprocated within a traverse stroke by means of an electric motor 7, for example a stepping motor.

The motion of the electric motor 7 is transmitted to the traversing yarn guide 3 via a belt 6. The belt 6 loops about belt pulleys 4.1 and 4.2 as well as a drive pulley 5. The traversing yarn guide 3 is fixedly mounted on the endless belt 6 and reciprocated on the belt 6 between belt pulleys 4.1 and 4.2. The belt pulleys 4.1 and 4.2 are each mounted for free rotation about an axle. The drive pulley 5 is mounted or a motor shaft 9. The motor shaft 9 is driven by the electric motor 7 in alternating directions of rotation.

Arranged parallel to the belt 6 extending between belt pulleys 4.1 and 4.2 is a winding spindle 14 which mounts a winding tube 15. On the tube 15, a yarn package 1 is wound. A drive roll 2 lies against the surface of package 1 which is formed on the tube. The winding spindle 14 is driven via the drive roll being in circumferential contact with the package 1. A yarn 13 which is wound on package 1 is reciprocated by traversing yarn guide 3 according to a preselected law of winding within the traverse stroke.

In this process, the position of the traversing yarn guide may assume any desired values within the traverse stroke. The positions of the traversing yarn guide within the traverse stroke are determined by the electric motor 7. The diameter of the drive pulley is determined by the torque of the electric motor 7 and the traverse stroke of traversing yarn guide 3. The circumference of the drive pulley 5 may be smaller or larger than the traverse stroke of the yarn guide. The drive pulley 5 is made of a light material, for example, plastic, so as to realize a low mass moment of inertia.

The electric motor 7 is controllable via a control device 11. The control device 11 receives from a primary controller the sequences of desired positions within the traverse stroke. In this connection, it is possible to input, with respect to every law of winding, the desired values that are characteristic of the traversing yarn guide in its position and speed. Moreover, it is possible to input values for breaking ribbons during the winding, as well as for shortening the traverse stroke. To this end, the control device 11 receives rotational speed signals of package 1 and drive roll 2.

The control device 11 is connected to a measuring device 8. The measuring device 8 comprises a sensor 10, which detects the actual position of traversing yarn guide 3. The position of traversing yarn guide 3 is measured by the sensor both within the traverse stroke and even outside thereof, for example, during a yarn change. The measuring device 8 transmits the measuring signals to the control device 11.

In FIG. 1, the measuring device 8 is connected to an electric sensor 10 which is in contact with traversing yarn guide 3.

In this embodiment, the sensor 10 consists of a potentiometer, on which the traversing yarn guide is reciprocated, and thus generates an electric signal, which is received by the linear distance measuring device 8 and supplied to the control device 11. To detect the position of the traversing yarn guide in a noncontacting manner, the sensor 10 may be magnetically coupled with the traversing yarn guide 3.

FIG. 2 shows a measuring device which comprises an optical sensor 10. The optical sensor 10 generates a laser beam that is directed toward the traversing yarn guide. The measuring signal is again supplied from the measuring device 8 to the control device 11. In this process, the distance measured by the optical sensor can be transferred within the linear distance measuring device 8 to a position of the traversing yarn guide.

FIG. 2 shows another variant of the embodiment in dashed lines. In this variant, the measuring device with the optical sensor 10 is arranged in such a manner that the belt 6 is sensed by optical sensor 10. It would likewise be possible to arrange the sensor within the belt drive, so as to use as signals the projections formed in the belt in the case of a cog belt.

FIG. 3 illustrates a further embodiment, wherein the measuring device is arranged directly on the electric motor 7. In this embodiment, the sensor 10 of the measuring device 8 is designed as a rotation pickup, and it detects the angular position or rotation of motor shaft 9.

However, it is also possible to arrange the rotation pickup with the linear distance measuring device on one of the belt pulleys 4.1 or 4.2, as shown by dashed lines in FIG. 3.

All measuring devices shown in FIGS. 1–3 detect the actual position of the traversing yarn guide during the winding cycle. The actual position is supplied to the control device 11, which performs a comparison between predetermined desired values and actual values of the position of the traversing yarn guide. A differential signal generated by the control device 11 is supplied to the electric motor 7 for controlling same. For example, the coils of the electric motor 7 may be switched in such a manner that the position and speed are varied. The control device 11 includes a microprocessor control and a power component for the electric motor. By means of this power component, it is possible to cover the motor current and to change the torque of the electric motor 7. Thus, both the angular position and the rotational speed of the motor shaft are controlled. The traversing apparatus requires no special alignment of the shaft of motor 7 with respect to the traversing yarn guide 3. To determine the position of the traversing yarn guide, the control device 11 may perform a reference run prior to the start of the winding operation, so that the electric motor 7 is operated with a very low torque in one direction to one of belt pulleys 4.1 or 4.2. The low torque will cause no mechanical damage.

During the winding operation, the control device 11 may monitor the belt for breakage, in that the motor current is monitored for variation. The belt 6 may also be monitored for breakage by a local control unit during the reference run by supervising the timing.

Basically, the rotation of electric motor 7 may also be transmitted by other beltlike means, such as, for example, cables, tapes, chains, or wires.

Figure 4:
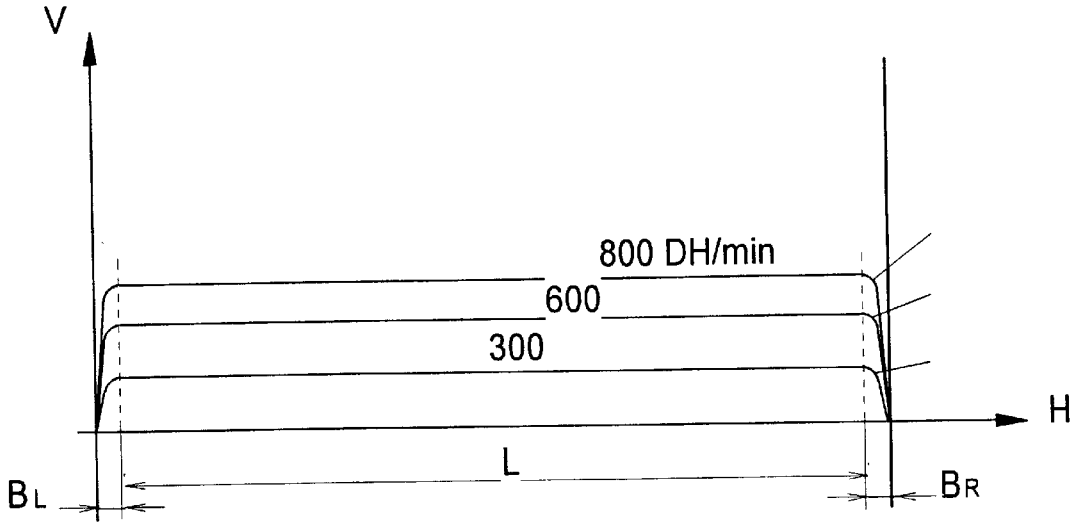
FIG. 4 is a diagram with a plurality of curves of the desired position of the traversing yarn guide within a traverse stroke.

FIG. 4 illustrates by way of example a diagram showing the curve of the desired position of the traversing yarn guide. Plotted on the ordinate is the distance covered by the traveling yarn guide. The traverse stroke H is formed by partial lengths $B_L$, L and $B_R$. In the case of a traversed yarn guide, same is decelerated at each stroke end from its guiding speed and again accelerated. The diagram shows a basic relation between the speed of the traversing yarn guide and the traverse stroke. The reversal of the lengths at the ends of the traverse stroke are indicated at $B_L$ and $B_R$. The speed of the traversing yarn guide is plotted on the abscissa. Starting at the origin of the diagram, the yarn guide is first accelerated. This acceleration occurs in accordance with a function, which may be of any desired shape, for example, circular, parabolic, hyperbolic, etc. The acceleration phase of the traversing yarn guide is completed, after a predetermined guiding speed is reached. This point is indicated by the transition from the reversal length B to the linear length L. Within the linear length, the speed of the yarn is constant. To reverse the movement of the yarn guide at the opposite end, the yarn guide is decelerated within the reversal length $B_R$. The deceleration of the yarn guide occurs again in accordance with a function. Once the yarn guide has a zero speed, the entire sequence is repeated.

FIG. 4 shows three curves with different guiding speeds. To identify the guiding speed, the double stroke rates per minute of the traversing yarn guide are indicated. These double stroke rates are values of 300, 600, 800 double strokes per minute which are commonly adjusted in practice. As a result of these curves, the desired position of the yarn guide as regards its location and speed is predetermined, and it is used for controlling the electric motor. In a comparison between actual and desired values, the respectively determined actual position as regards location and speed is compared with the desired position. A differential signal generated by the control device will result in a corresponding control of the electric motor.

Figure 5:
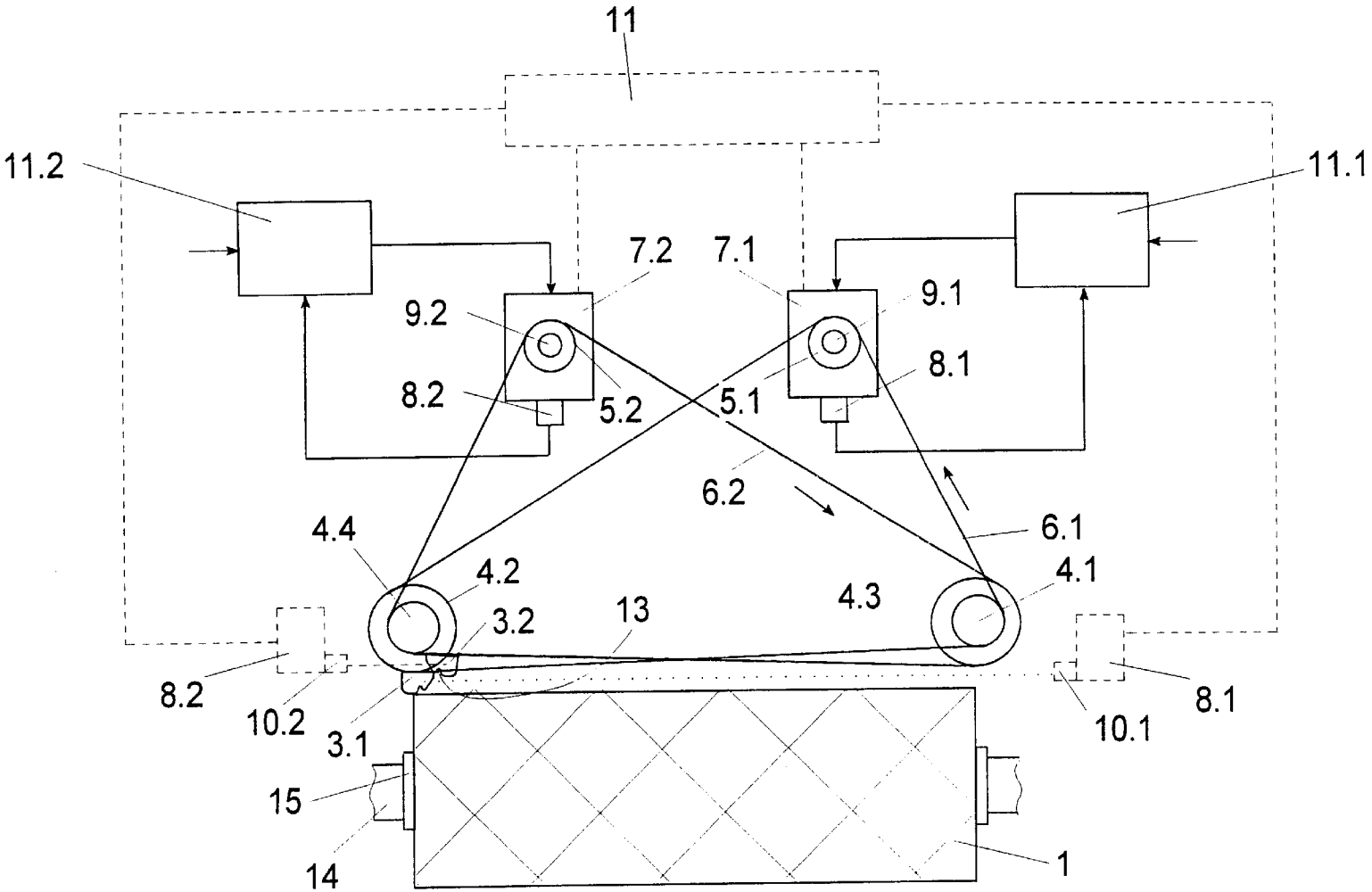
FIG. 5 is a schematic view of a further embodiment of a traversing apparatus in accordance with the invention.

FIG. 5 illustrates a further embodiment of a traversing apparatus in accordance with the invention. In this Figure, identical functional components are shown by like reference numerals.

The traversing apparatus comprises two belt drives with crossing belts 6.1 and 6.2. A first belt drive is formed by a drive pulley 5.1 and belt pulleys 4.1 and 4.2, which guide an endless belt 6.1. The drive pulley 5.1 is mounted on one end of a motor shaft 9.1, and it is driven by an electric motor 7.1 in counterclockwise direction (direction of arrow). The belt 6.1 mounts a yarn guide 3.1.

The second belt drive comprises a drive pulley 5.2 and belt pulleys 4.3 and 4.4, as well an endless belt 6.2 that is guided therein. The drive pulley 5.2 is mounted on a motor shaft 9.2 and driven by means of an electric motor 7.2 in clockwise direction (direction of arrow). The belt 6.2 mounts a yarn guide 3.2. The belt drives are arranged in planes parallel to each other, so that the belt pulleys 4.1 and 4.3 as well as belt pulleys 4.2 and 4.4 are coaxial with one another. A package 1 being wound is arranged parallel to the belt pulleys below the belt drives. The package 1 is wound on a tube 15, which is driven via a winding spindle 14. The winding spindle 14 may be driven, for example, by an electric motor. Between the belt drive and package 1, a contact roll is arranged, which is not shown in FIG. 5 for the sake of clarity.

The contact roll lies against the package surface under a contact force. The contact roll that is driven by the package 1 is operated at a constant rotational speed during a winding cycle. To this end, the drive of the winding spindle 14 is slowed down in accordance with the increase in diameter.

A yarn 13 which advances substantially perpendicularly into the plane of the drawing is guided by means of yarn guides 3.1 and 3.2 along the traverse length, which is substantially identical with the package length. In the position shown in FIG. 5, the yarn 13 is currently being guided by traversing yarn guide 3.2 toward the left end of the package by means of belt 6.2. In comparison with coaxial belt pulley 4.2 of the second belt drive, the belt pulley 4.4 has a smaller diameter. As a result, the traversing yarn guide 3.2 moves in part below the traversing yarn guide 3.1 and, thus releases the yarn from its guide notch. After the yarn is received by yarn guide 3.1 at the end of the traverse length, the yarn is guided in the opposite direction to the right end of the package 14. Since the belt pulley 4.1 of belt 6.1 has a smaller diameter than the belt pulley 4.3 of belt 6.2, the belts 6.1 and 6.2 cross each. Thus, the yarn transfer is repeated at the right end of the package in the same manner as the yarn transfer at the left end of the package. While the yarn is being guided by traversing yarn guide 3.2, the actual position of the traversing yarn guide 3.2 is measured via a measuring device 8.2 arranged on electric motor 7.2. The measuring device 8.2 is identical with that shown in FIG. 3. In this respect, the description of FIG. 3 is herewith incorporated by reference. The measuring device 8.2 is connected to a control device 11.2, which controls the electric motor 7.2. The electric motor 7.2 is controlled in such a manner that the yarn guide 3.2 is moved at a guiding speed, while guiding the yarn. After the yarn is transferred to the yarn guide 3.1 at the end of the traverse length, the yarn guide 3.2 is moved by the electric motor 7.2 at a change speed, which is higher than the guiding speed. When determining the actual position of the traversing yarn guide, it is thus possible to determine any position of the yarn guide based on the control speed of the motor and the number of revolutions.

Likewise arranged on the electric motor 7.1 is a measuring device 8.1, which is connected to a control device 11.1 associated to the electric motor 7.1. The electric motor 7.1 is controlled in a manner analogous to the control of electric motor 7.2. The control devices 11.1 and 11.2 are interconnected via a central controller. As a result of this interconnection, it is possible to control both the guiding speed and the change speed of the two belt drives such that the yarn is transferred in a predetermined point at the stroke end. In this connection, the control of the traverse drives that is made possible by the linear distance measuring devices ensures an exact observance of the transfer points during the yarn transfer in the stroke ends.

A further, possible arrangement is shown by dashed lines in FIG. 5. In this arrangement, the electric motors 7.1 and 7.2 are directly controlled by a central controlling device 11, which is connected to a control measurement device 8.2 that determines the actual position of the traversing yarn guide 3.1, and to a linear distance measuring device 8.1 that determines the actual position of traversing yarn guide 3.2. In this arrangement, the traversing yarn guides are covered in their position only within the traverse length. Outside of the traverse length, while the traversing yarn guides are being operated at the change speed, it is not contemplated to cover their positions. Thus, the electric motors 7.1 and 7.2 are controlled only during the phase, in which the motor is driven at the guiding speed.

Figure 6:
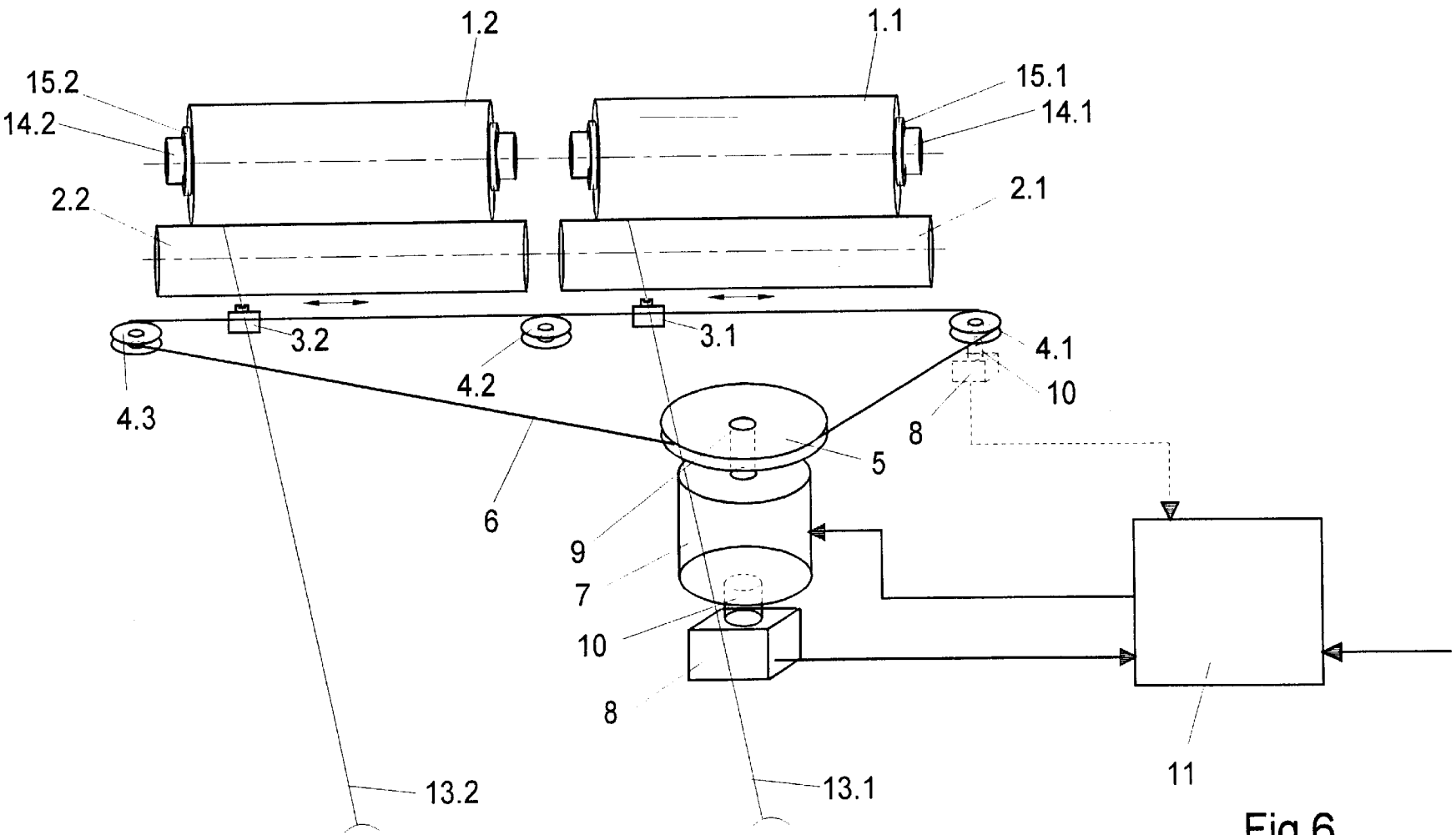
FIG. 6 is a schematic view of a further embodiment of a traversing apparatus in accordance with the invention.

The traversing apparatus of the present invention is not limited to only one winding position, but may be extended to as many juxtaposed winding positions as desired. For example, as illustrated in FIG. 6, two winding spindles 14.1 and 14.2 may be coaxially arranged to support two winding tubes 15.1 and 15.2. The tubes are driven by the drive rolls 2.1 and 2.2 and form the yarns 13.1 and 13.2 into packages 1.1 and 1.2 respectively. Two traversing yarn guides 3.1 and 3.2, arranged one after the other, are mounted on a common belt 6 which is driven by an electric motor 7. In the illustrated embodiment, a measuring device 8 is associated with only one traversing yarn guide 3.1.

A traversing apparatus of FIG. 5 may be extended in such a manner that likewise a plurality of yarn guides are mounted one after the other on one belt drive. In this instance, the belt drives could be arranged in a mirror-inverted manner, so that the traversing yarn guides guided on the belt respectively face one another.

However, the invention is not limited to traversing apparatus, which move a traversing yarn guide by means of a belt drive. Basically, it is possible to control in accordance with the invention any traverse drive arrangement, wherein a yarn guide is moved and positioned by means of a drive. The constant adjustment between the actual position and the desired position of the traversing yarn guide leads to a very high accuracy in the yarn deposit. Thus, it is possible to reproduce the package buildups in each package being wound.

We claim:

1. A method of winding an advancing yarn to form a wound package, comprising the steps of traversing at least one yarn guide back and forth along a rotating winding tube by means of an electric motor, while guiding the advancing yarn through the at least one traversing yarn guide and onto the rotating winding tube and so as to define a traverse stroke, continuously monitoring the actual position of the at least one traversing yarn guide within the traverse stroke, while comparing the monitored actual position of the at least one traversing yarn guide with a predetermined desired position, and generating a control signal in response to a difference between the monitored actual position of the at least one traversing yarn guide and the predetermined desired position so as to control the operation of the electric motor and thereby accurately position the yarn along the entire traverse stroke in accordance with a predetermined winding program.

2. The method as defined in claim 1 wherein the generated control signal acts to control the rotational speed of the electric motor.

3. The method as defined in claim 1 wherein the comparing step includes comparing a sequence of monitored actual positions with a sequence of the desired positions with respect to location and/or speed.

4. The method as defined in claim 3 wherein the sequence of desired positions is designed to achieve a predetermined type of wind in the resulting package.

5. The method as defined in claim 1 comprising the further initial step of adjusting the at least one traversing yarn guide to a reference position with respect to a setting of the electric motor.

6. The method as defined in claim 5 wherein the reference position is defined by one of the ends of the winding tube.

7. The method as defined in claim 1 wherein the step of continuously monitoring the actual position of the at least one traversing yarn guide includes optically, acoustically, or electrically monitoring the actual position of the yarn guide by means of a sensor.

8. The method as defined in claim 7 wherein the step of traversing the at least one yarn guide includes circulating a drive belt about a drive pulley which is connected to a drive shaft of the electric motor, and about at least one guide pulley, with the at least one traversing yarn guide affixed to the circulating drive belt.

9. The method as defined in claim 8 wherein the step of continuously monitoring the actual position of the at least one traversing yarn guide includes monitoring the angle of rotation or the number of rotations of at least one of the drive pulley and the one guide pulley.

10. The method as defined in claim 8 wherein the drive belt includes a number of markings arranged per unit length on the drive belt, and wherein the step of continuously monitoring the actual position of the at least one traversing yarn guide includes monitoring the markings on the drive belt.

11. The method as defined in claim 1 wherein the step of traversing at least one yarn guide comprises reciprocating a single yarn guide along the traverse stroke.

12. The method as defined in claim 1 wherein the step of traversing at least one yarn guide comprises traversing two oppositely moving yarn guides along the traverse stroke, while transferring the advancing yarn from one yarn guide to the other at each of the ends of the traverse stroke.

13. An apparatus for winding an advancing yarn to form a wound package, comprising a winding spindle adapted for coaxially mounting a winding tube thereupon, drive means for rotatably driving the winding tube, a yarn traversing mechanism for reciprocating an advancing yarn along the rotating winding tube to form a wound package thereon, said yarn traversing mechanism including (a) at least one yarn guide, (b) means including an electric motor for traversing the at least one yarn guide along the rotating winding spindle and so as to define a traverse stroke, (c) a sensor for continuously monitoring the actual position of the at least one yarn guide as it moves along the traverse stroke, and (d) control means for comparing the monitored actual position of the at least one yarn guide with a predetermined desired position, and generating a control signal in response to a difference between the monitored actual position of the at least one yarn guide and the predetermined desired position so as to control the operation of the electric motor and thereby accurately position the yarn along the entire traverse stroke in accordance with a predetermined winding program.

14. The apparatus as defined in claim 13 wherein the at least one yarn guide comprises a single yarn guide which is reciprocated in opposite directions along the traverse stroke.

15. The apparatus as defined in claim 13 wherein the yarn traversing mechanism comprises a plurality of yarn guides for respectively traversing a plurality of yarns in parallel arranged winding positions, with the plurality of yarn guides being mounted on a common drive belt which is traversed by said electric motor, and wherein at least one of the plurality of yarn guides is associated with the sensor.

16. The apparatus as defined in claim 13 wherein the sensor is in contact with the at least one yarn guide.

17. The apparatus as defined in claim 13 wherein the sensor is out of direct contact with the at least one yarn guide.

18. The apparatus as defined in claim 13 wherein the sensor is connected to the means for traversing the at least one yarn guide.

19. The apparatus as defined in claim 13 wherein the means for traversing the at least one yarn guide further comprises a drive belt which is entrained about a drive pulley which is connected to a drive shaft of the electric motor, and about at least one guide pulley, and wherein the at least one yarn guide is affixed to the circulating drive belt.

20. The apparatus as defined in claim 13 wherein the sensor continuously monitors the angle of rotation or the number of rotations of at least one of the drive pulley and the one guide pulley.

21. The apparatus as defined in claim 13 wherein the drive belt includes a number of markings arranged per unit length on the drive belt, and wherein the sensor continuously monitors the markings on the drive belt.

22. The apparatus as defined in claim 13 wherein the sensor is mounted on the electric motor so as to be adapted to monitor the angular position or the number of revolutions of the motor.

23. The apparatus as defined in claim 13 wherein the electric motor is a stepping motor.

24. An apparatus for winding an advancing yarn to form a wound package, comprising a winding spindle adapted for coaxially mounting a winding tube thereupon, drive means for rotatably driving the winding tube, a yarn traversing mechanism for reciprocating an advancing yarn along the rotating winding tube to form a wound package thereon, said yarn traversing mechanism including (a) first and second yarn guides, (b) means including a first electric motor for traversing the first yarn guide along the rotating winding spindle and so as to define a traverse stroke, (c) a sensor for continuously monitoring the actual position of the first yarn guide as it moves along the traverse stroke, (d) control means for comparing the monitored actual position of the first yarn guide with a predetermined desired position, and generating a control signal in response to a difference between the monitored actual position of the first yarn guide and the predetermined desired position so as to control the operation of the first electric motor and thereby accurately position the yarn along the entire traverse stroke in accordance with a predetermined winding program, (e) means including a second electric motor for traversing the second yarn guide along the traverse stroke in a direction opposite the direction of movement of the first yarn guide, (f) a second sensor for continuously monitoring the actual position of the second yarn guide as it moves along the traverse stroke, and (g) control means for comparing the monitored actual position of the second yarn guide with a predetermined desired position, and generating a control signal in response to a difference between the monitored actual position of the second yarn guide and the predetermined desired position so as to control the operation of the second electric motor and thereby accurately position the yarn along the entire traverse stroke in accordance with the predetermined winding program.

25. The apparatus as defined in claim 24 wherein the first and second yarn guides are positioned and configured such that the advancing yarn is transferred at each end of the traverse stroke from one yarn guide to the other.

* * * * *